US008613483B2

(12) United States Patent
Hsiao

(10) Patent No.: US 8,613,483 B2
(45) Date of Patent: Dec. 24, 2013

(54) PAD STRUCTURE FOR A CHAIR BACK

(75) Inventor: Hsueh-Sheng Hsiao, Jhuci Township, Chiayi County (TW)

(73) Assignee: Chern Shing Top Co., Ltd, Jhuci Township (TW)

( * ) Notice: Subject to any disclaimer, the term of this patent is extended or adjusted under 35 U.S.C. 154(b) by 0 days.

(21) Appl. No.: 13/293,044

(22) Filed: Nov. 9, 2011

(65) Prior Publication Data

US 2012/0212024 A1 Aug. 23, 2012

(30) Foreign Application Priority Data

Feb. 22, 2011 (TW) ..... 100203189 U

(51) Int. Cl.
*B60N 2/02* (2006.01)

(52) U.S. Cl.
USPC ..... 297/353; 297/370

(58) Field of Classification Search
USPC ..... 297/353, 284.8, 370, 363, 317, 354.13, 297/230.13, 230.14, 284.4, 383, 391, 297/344.15
See application file for complete search history.

(56) References Cited

U.S. PATENT DOCUMENTS 1,922,418 A * 8/1933 Conant ..... 297/357
2,767,777 A * 10/1956 Kriger et al. ..... 297/383
3,022,037 A * 2/1962 Stallard ..... 248/421
3,899,209 A * 8/1975 Schulz ..... 297/383
4,032,103 A * 6/1977 Ehrichs ..... 248/421
4,700,921 A * 10/1987 Holbrook ..... 248/421
4,981,325 A * 1/1991 Zacharkow ..... 297/284.1
5,088,790 A * 2/1992 Wainwright et al. ..... 297/284.4
5,553,919 A * 9/1996 Dennis ..... 297/284.8
6,695,402 B2 * 2/2004 Sloan, Jr. ..... 297/284.4
6,719,371 B2 * 4/2004 Yoshie et al. ..... 297/344.15
6,938,956 B1 * 9/2005 Piretti ..... 297/284.7
7,360,837 B1 * 4/2008 Liu ..... 297/353
7,448,684 B2 * 11/2008 Hsiao ..... 297/284.8
7,967,379 B2 * 6/2011 Walters et al. ..... 297/284.3
2003/0057756 A1 * 3/2003 Lai ..... 297/353
2004/0124679 A1 * 7/2004 Teppo et al. ..... 297/284.4

* cited by examiner

*Primary Examiner* — David Dunn
*Assistant Examiner* — Richard Lowry
(74) *Attorney, Agent, or Firm* — Alan Kamrath; Kamrath IP Lawfirm, P.A.

(57) ABSTRACT

A pad structure for a chair back contains a pad, an adjusting member disposed on a back side of the pad, and a rail plate connected with the adjusting member. The pad is capable of being adjusted frontward and backward. The adjusting member includes a positioning panel to axially connect with a toothed edge of each of two toothed arms. Another end of one toothed arm is secured on a face of the rail plate by using a first connector, and another end of another toothed arm is coupled with a slideable deck by a second connector to form a multi-section engaging design. Thereby, the two toothed arms slide along the slideable plate to change a relative angle between the two toothed arms.

3 Claims, 8 Drawing Sheets

PAD STRUCTURE FOR A CHAIR BACK

BACKGROUND OF THE INVENTION

1. Field of the Invention

The present invention relates to a pad structure for a chair back capable of adjusting a relative angle between two toothed arms to change a position of the chair back to match with different figures or sitting postures to support a user.

2. Description of the Prior Art

A conventional chair back has a pad structure to support a user's back. Although the conventional chair back has an angle adjusting function, a position of the pad can not be changed (i.e., as adjusting an angle of the pad, a fulcrum is still used to swing). Thus, when changing a sitting posture or the pad is used by users with different figures, the pad can not be used in different requirements. For example, when the user is typing, he/she moves frontward so that his/her back moves away from the pad, and the user with a small figure can not keep a proper sitting posture to contact with the pad. Thus, most users purchase another pad to put it between the chair back and his/her back to form a double-pad structure, wasting the purchase cost.

Besides, the another pad can not make the user keep the proper sitting posture. A thickness of these two pads can not be changed, so the user can only sit at a specific posture to contact with one or the two pads, having the same problem.

The present invention has arisen to mitigate and/or obviate the afore-described disadvantages.

SUMMARY OF THE INVENTION

The primary objective of the present invention is to provide a pad structure for a chair back capable of obtaining a multi-section engaging design to push a slideable deck to raise two toothed arms to change a position of the chair back to match with different figures or sitting postures to support a user.

Another objective of the present invention is to provide a pad structure for a chair back in which a rail plate is connected with a chair to achieve frontward and backward adjustment of the pad. The rail plate abuts against a conventional pad to adjust a relative position of the two toothed arms to change a distance between a positioning panel and the rail plate to obtain an ergonomic adjustment.

To obtain the above objectives, a pad structure for a chair back contains a pad, an adjusting member disposed on a back side of the pad, and a rail plate connected with the adjusting member. The pad is capable of being adjusted frontward and backward. The adjusting member includes a positioning panel to axially connect with a toothed edge of each of the two toothed arms. Another end of one toothed arm is secured on a face of the rail plate by using a first connector, and another end of another toothed arm is coupled with a slideable deck by a second connector to form a multi-section engaging design.

DETAILED DESCRIPTION OF THE PREFERRED EMBODIMENTS

The present invention will be clearer from the following description when viewed together with the accompanying drawings, which show, for purpose of illustration only, the preferred embodiments in accordance with the present invention.

Figure 1:
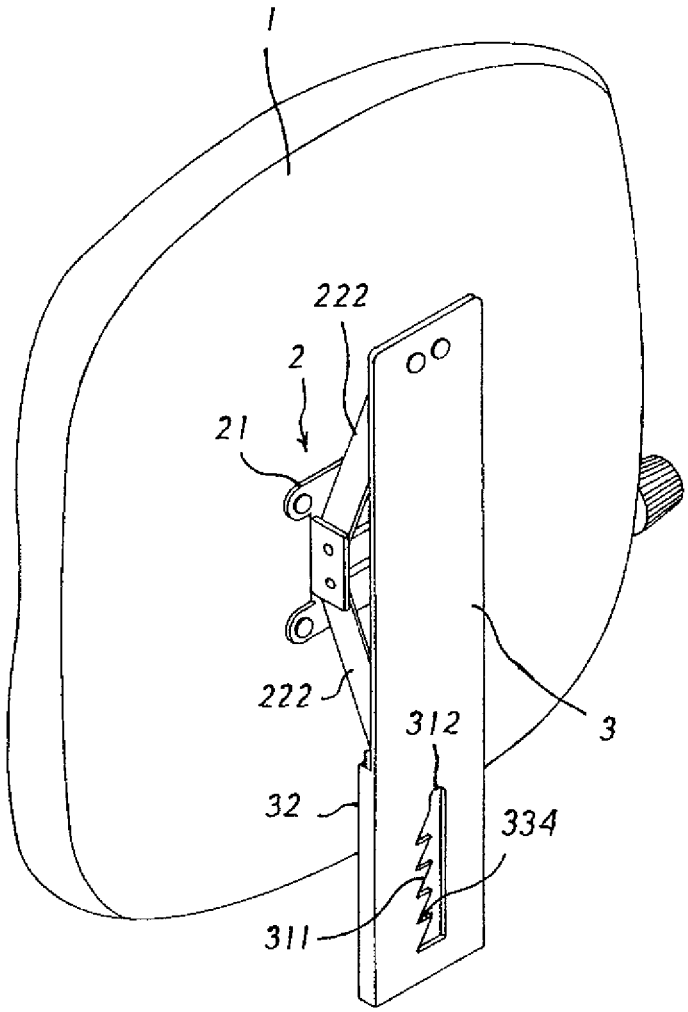
FIG. 1 is a perspective view showing the assembly of a pad structure for a chair back according to a preferred embodiment of the present invention.
Figure 2:
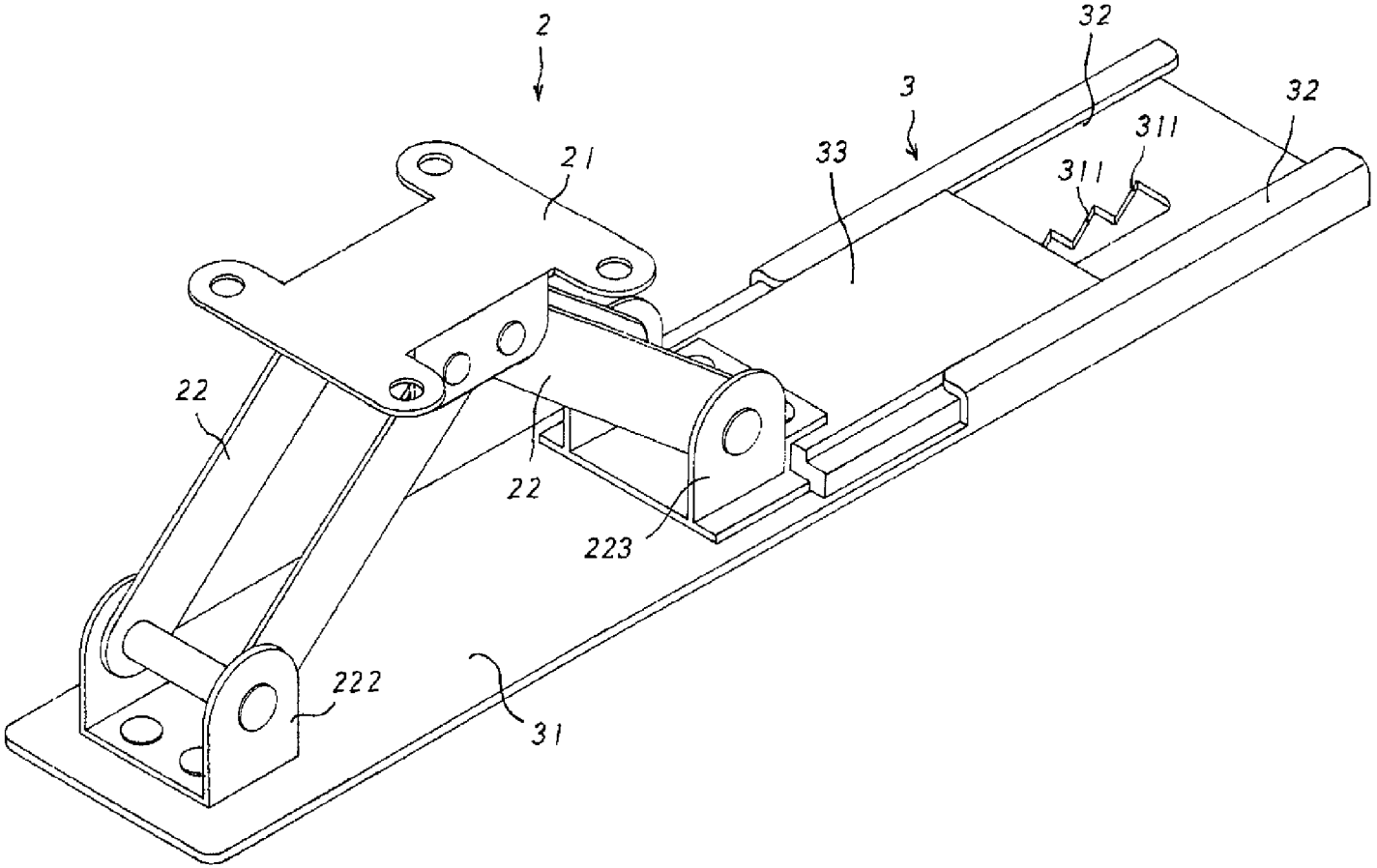
FIG. 2 is another perspective view showing the assembly of the pad structure for the chair back according to the preferred embodiment of the present invention.
Figure 3:
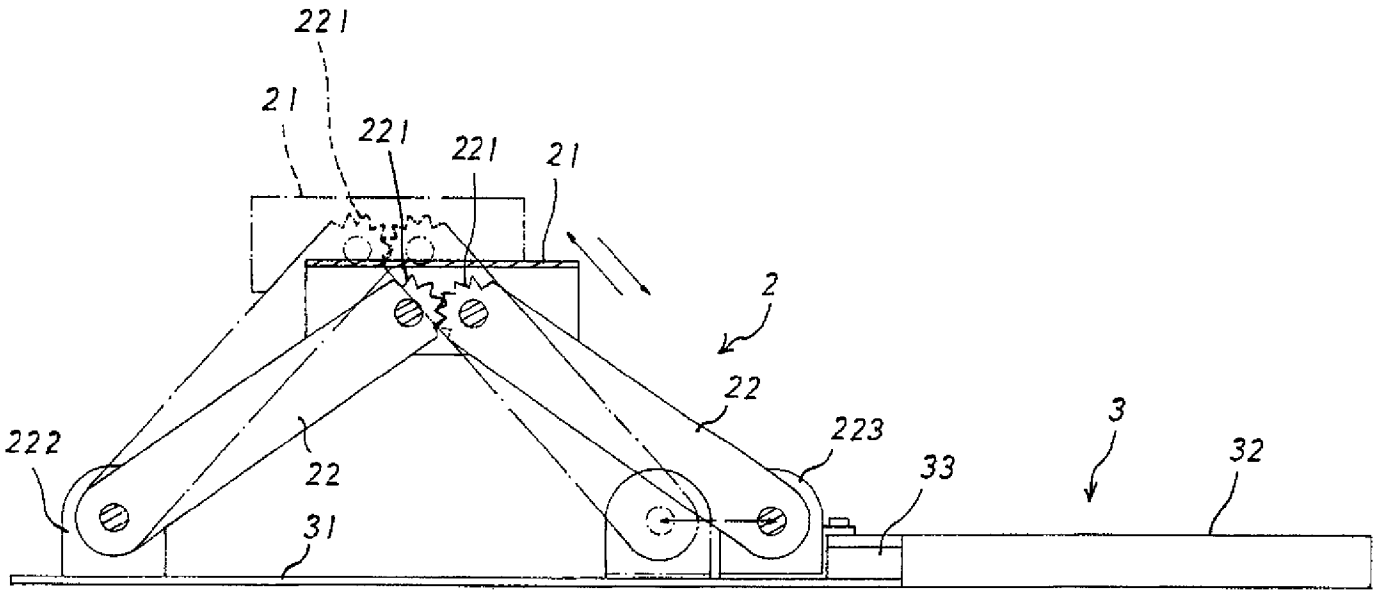
FIG. 3 is a cross sectional view showing the operation of the pad structure for the chair back according to the preferred embodiment of the present invention.

A pad structure for a chair back according to a preferred embodiment of the present invention comprises a pad 1, an adjusting member 2 disposed on a back side of the pad 1, and a rail plate 3 connected with the adjusting member 2. The pad 1 is capable of being adjusted frontward and backward (as shown in FIG. 1). The adjusting member 2 includes a positioning panel 21 to axially connect with a toothed edge 221 of each of the two toothed arms 22. Another end of one toothed arm 22 is secured on a face 31 of the rail plate 3 by using a first connector 222, and another end of another toothed arm 22 is coupled with a slideable deck 33 by a second connector 223 (as illustrated in FIGS. 2 and 3).

The rail plate 3 includes a rail 32 mounted on the face 31 thereof and connecting with a slideable deck 33 to form a multi-section engaging design.

Thereby, the positioning panel 21 of the adjusting member 2 is fixed on the back side of the pad 1 so that the pad 1 moves with an expansion and retraction of a relative angle of the two toothed arms 22 of the adjusting member 2.

Figure 4:
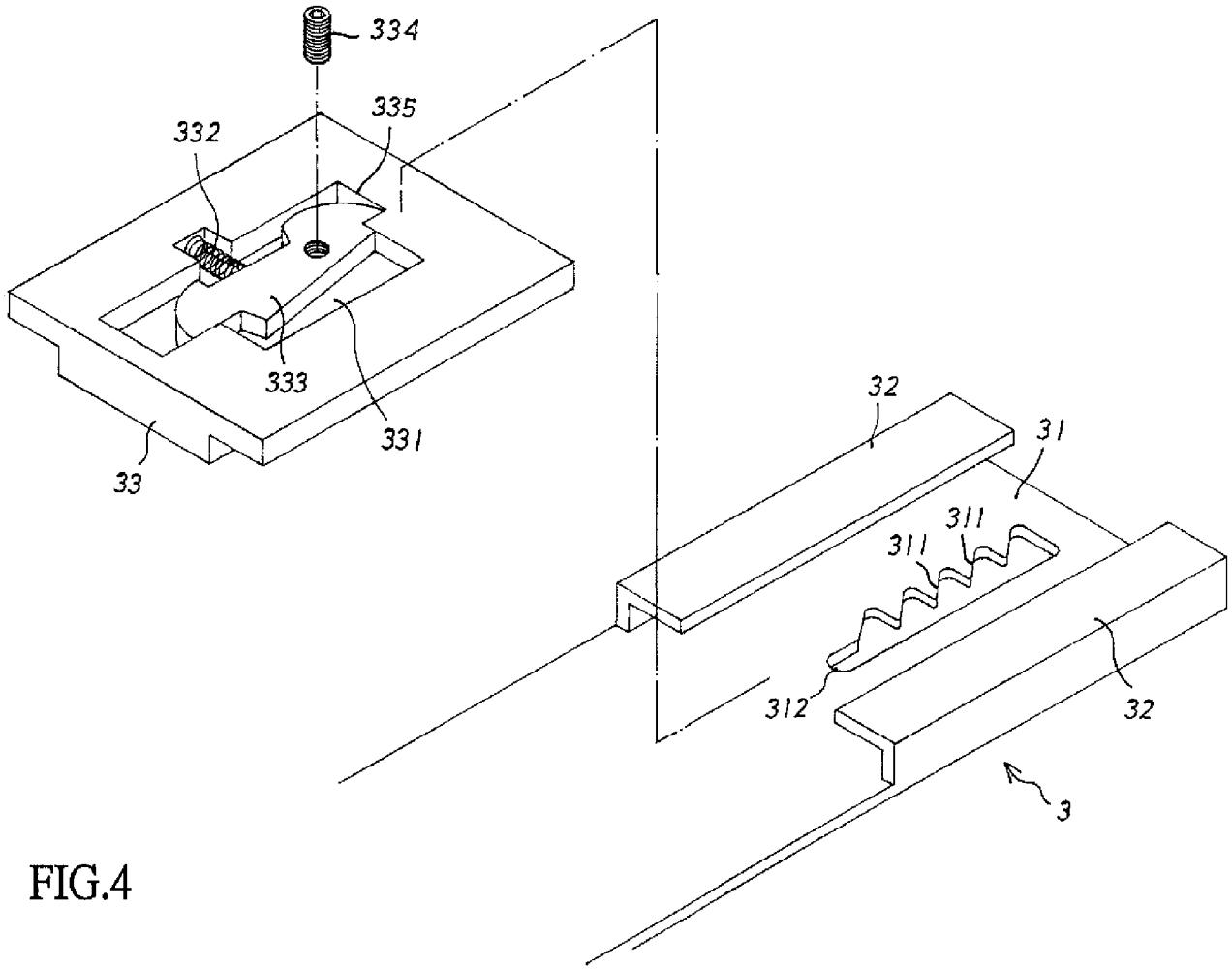
FIG. 4 is a perspective view showing the exploded components of the pad structure for the chair back according to the preferred embodiment of the present invention.

The pad structure for the chair back of the present invention can be adjusted by the multi-section engaging design between the rail 32 and the slideable deck 33 of the rail plate 3. As shown in FIG. 4, because various multi-section engaging designs can match with the adjusting member 2 to embody the present invention, it is not limited in a certain scope. Taking a conventional pad structure for example, the multi-section engaging design includes a plurality of successively serrate recesses 311 arranged on the face 31 of the rail 32. A groove 331 is formed in the slideable deck 33 to receive a movable piece 333 biased by a spring 332, and the movable piece 333 includes a column 334 screwed thereon and inserted in one of the serrate recesses 311. Thus, when the slideable deck 33 slides relative to the rail 32, the column 334 moves along the serrate recesses 311 to form an engaging and stopping effect, and when the column 334 is pulled toward a straight slot 312 of a top end of the serrate recesses 311, one end of the movable piece 333 slides into a notch 335 of the groove 331. When the spring 332 is pressed, the slideable deck 33 abuts against a bottom end of the serrate recesses 311, and, then, the movable piece 333 slides out of the notch 335 so that the column 334 engages with the serrate recesses 311 again. The slideable deck 33 slides along the rail 32, and the relative angle of the two toothed arms 22 is changed. Since the two toothed arms 22 engage with each other by using toothed edges 221 thereof, a transmission is generated, and the positioning panel 21 will not swing. A distance between the positioning panel 21 and the rail plate 3 is changed to adjust the pad 1 and the rail plate 3 frontward and backward.

Figure 5:
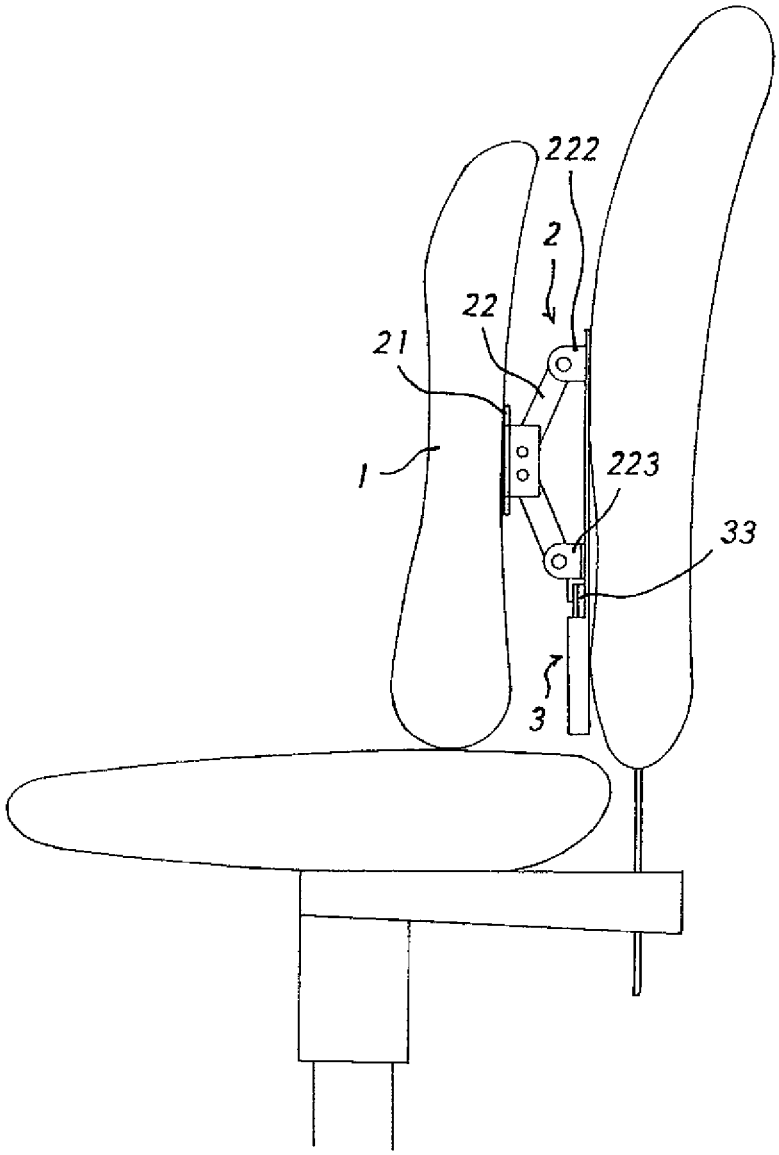
FIG. 5 is a plan view showing the application of the pad structure for the chair back according to the preferred embodiment of the present invention.
Figure 6:
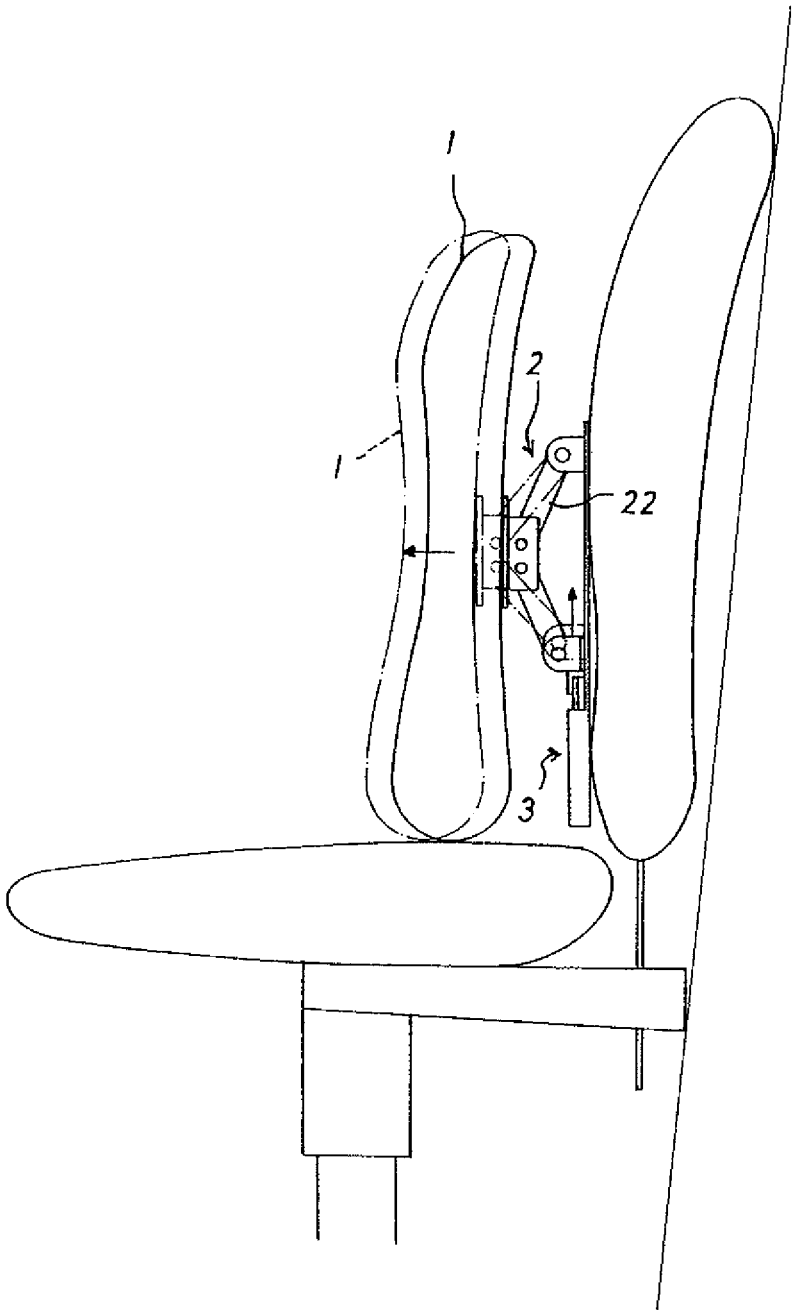
FIG. 6 is a plan view showing the operation of the pad structure for the chair back according to the preferred embodiment of the present invention.

As the slideable deck 33 is pushed to move relative to the first connector 222 and as it is also allowed to pull the pad 1 directly to actuate the slideable deck 33 while positioning the rail plate 3, the two toothed arms 22 raise to be close to a user's back (as shown in FIGS. 5 and 6) to be suitable for a user who sits forward or has a small figure. Alternately, when the toothed arms 22 are in a flat condition, the pad 1 is located at a back position to support a back of the user who sits backward or has a large figure.

Figure 7:
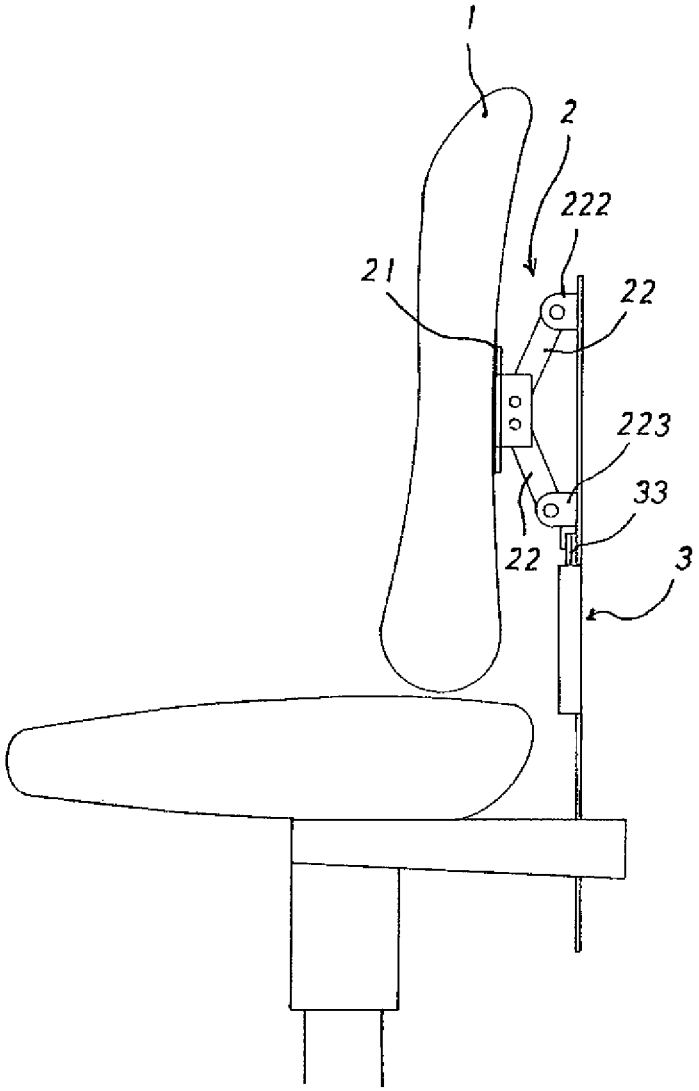
FIG. 7 is another plan view showing the application of the pad structure for the chair back according to the preferred embodiment of the present invention.
Figure 8:
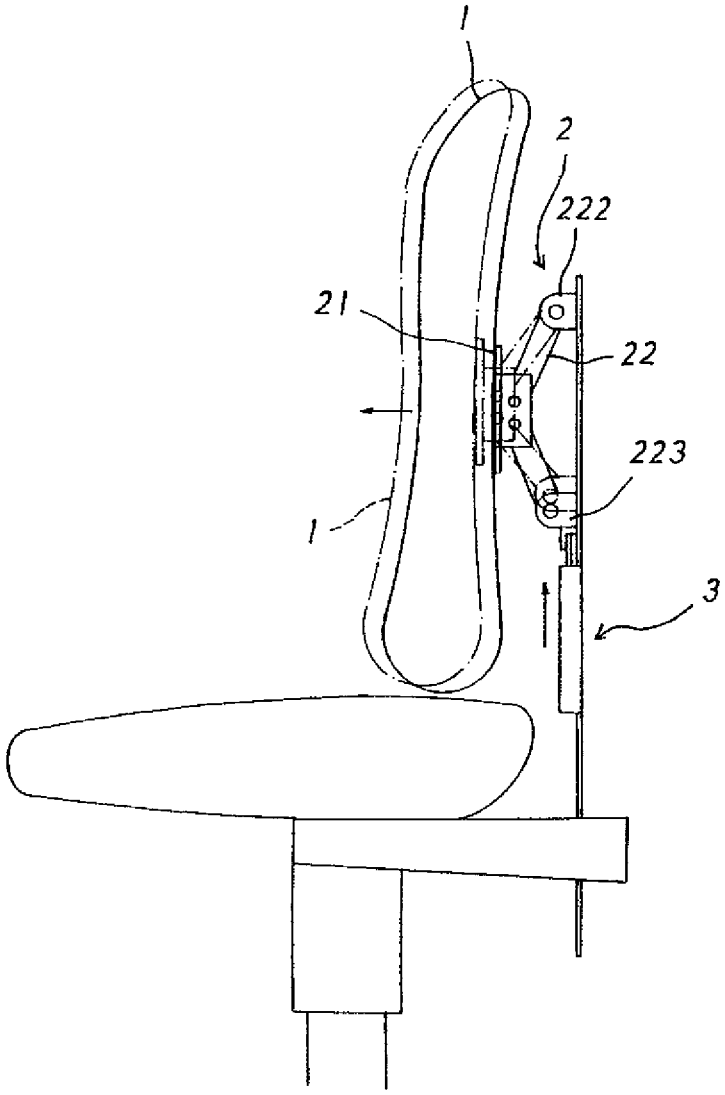
FIG. 8 is also another plan view showing the application of the pad structure for the chair back according to the preferred embodiment of the present invention.

The pad 1 is capable of contacting with a conventional pad for a chair by the rail plate 3 to obtain an ergonomic adjustment. In addition, the pad 1 is directly connected with the chair by the rail plate 3 so that the chair is equipped with the pad 1 having a frontward and backward adjustment function. Referring to FIGS. 7 and 8, in the assembly of the rail plate 3, the rail plate 3 has a longer length or is twisted at a specific angle to connect with a bottom disk of the chair, but it does not involve in a specific skill and is not beyond the scope of the present invention, so further remarks are omitted.

While various embodiments in accordance with the present invention have been shown and described, it is clear to those skilled in the art that further embodiments may be made without departing from the scope of the present invention.

What is claimed is:

1. A pad structure for a chair back comprising:

a pad, an adjusting member disposed on a back side of the pad, a rail plate connected with the adjusting member, a slideable plate slideably mounted to the rail plate, a straight slot having a plurality of serrate recesses extending from the straight slot, with the straight slot and the plurality of serrate recesses formed in the rail plate, a column projecting from the slideable plate and into the straight slot and movable into one of the plurality of serrate recesses, and a moveable piece movably mounted to the slideable plate, with the column mounted to the moveable piece, wherein the pad is capable of being adjusted frontward and backward, wherein the adjusting member includes a positioning panel to axially connect with a toothed edge of each of first and second toothed arms, and another end of the first toothed arm is secured on a face of the rail plate by using a first connector, wherein another end of the second toothed arm is coupled with the slideable plate by a second connector to form a multi-section engaging design;

wherein movement of the slideable plate along the rail plate changes a relative angle between the first and second toothed arms; and wherein the slideable plate includes a groove receiving the moveable piece, with the groove including a notch, with one end of the moveable piece slideable in the notch, with a spring sandwiched between the moveable piece and a portion of the groove.

2. The pad structure for the chair back as claimed in claim 1, wherein the multi-section engaging design is used to change the relative angle between the first and second toothed arms to obtain a stopping effect.

3. The pad structure for the chair back as claimed in claim 1, wherein the rail plate connects with a bottom disk of a chair.

* * * * *